US008987568B1

(12) United States Patent
Fucci

(10) Patent No.: US 8,987,568 B1
(45) Date of Patent: Mar. 24, 2015

(54) FUCCION

(71) Applicant: Ed Fucci, Lakeland, FL (US)

(72) Inventor: Ed Fucci, Lakeland, FL (US)

( * ) Notice: Subject to any disclaimer, the term of this patent is extended or adjusted under 35 U.S.C. 154(b) by 0 days.

(21) Appl. No.: 14/468,140

(22) Filed: Aug. 25, 2014

Related U.S. Application Data

(60) Provisional application No. 61/874,520, filed on Sep. 6, 2013.

(51) Int. Cl.
*G10D 1/08* (2006.01)
*G10D 15/00* (2006.01)

(52) U.S. Cl.
CPC . *G10D 15/00* (2013.01); *G10D 1/08* (2013.01)
USPC ..... 84/263

(58) Field of Classification Search
CPC ..... G10D 1/08
USPC ..... 84/263, 267, 290, 291
See application file for complete search history.

(56) References Cited

U.S. PATENT DOCUMENTS 4,377,101 A 3/1983 Santucci
4,483,233 A 11/1984 Benson
4,987,815 A * 1/1991 Shockley ..... 84/291
6,346,661 B1 2/2002 Yaskoweak
6,660,918 B1 12/2003 Yaskoweak
6,774,291 B2 8/2004 Vartiainen
8,319,081 B1 11/2012 Ridge
2003/0188622 A1* 10/2003 Wilson ..... 84/267
2005/0155480 A1 7/2005 Joseph
2013/0228060 A1 9/2013 Linden et al.

* cited by examiner

*Primary Examiner* — Kimberly Lockett
(74) *Attorney, Agent, or Firm* — KB Patents; Luca D'Ottone

(57) ABSTRACT

The inventive device described in the application is a novel musical instrument. The Fuccion is designed to be primarily played as a bass and a guitar simultaneously. This will provide the user with the ability to play music within a band or performance both as bass and as guitar. The Fuccion goes beyond just combining two different instruments because the final result it is in fact a novel concept. The Fuccion is a 10 String Instrument having a 6 string guitar formation above a 4 string base formation designed to play both parts simultaneously. This is due to the innovative body design which situates the necks in this unique staggered position allowing the right hand to both strum the guitar with the thumb and hammer out the bass notes with four fingers. Both necks are reachable in a single hand span. It is emphasized that this abstract is provided to comply with the rules requiring an abstract that will allow a searcher or other reader to quickly ascertain the subject matter of the technical disclosure.

12 Claims, 12 Drawing Sheets

FUCCION

CLAIM OF PRIORITY FROM RELATED APPLICATIONS

The present application claims priority from U.S. Provisional Patent Application No. 61/874,520 filed on Sep. 6, 2014 to Edmond A. Fucci from Lakeland, (Fla.) directed to a Double Neck Guitar Bass Combo that is hereby incorporated by reference. Because of the novelty involved in the development of the present invention the inventor felt to call the Double Neck Guitar Bass Combo hereby described as the Fuccion. While not claim is make on the name, the new name is needed to indicate the new musical instrument.

BACKGROUND OF THE INVENTION

1. Field of the Invention

The inventive device described in the instant application is a novel musical instrument. The Fuccion is designed to be primarily used in music performances as both a bass guitar and an electric guitar. This will provide the user with the ability to play music within a band or performance both as bass and as guitar. The Fuccion goes beyond just combining two different instruments because the final result it is in fact a novel concept.

The Fuccion is a new musical instrument that enables a musician to play bass and guitar parts at the same time, simultaneously. That is: One player, one instrument, two parts together. Which means bass and guitar at the same time.

2. Brief Description of the Prior Art

Compound instrumental music devices are well known in the art. Various Patents and Published Patent applications are in fact directed to text projectors. While developing the invention of the instant application independently the Inventor researched extensively the public record as well as the current market for duo musical instruments and the most relevant examples found in the search are mentioned in the Information Disclosure Statement (IDS) attached.

A multi-neck guitar is a guitar that has multiple fingerboard necks. They exist in both electric and acoustic versions. Although multi-neck guitars are quite common today, they are not a modern invention. Examples of multi-neck guitars and lutes go back at least to the Renaissance.

Today, the most common type of multi-neck guitar is the double neck guitar, of which the most common version is an electric guitar with twelve strings on the upper neck, while the lower neck has the normal six. Combination six-string and bass guitar are also used, as well as a fretless guitar with a regular fretted guitar, or any other combination of guitar neck and pickup styles. There are also acoustic versions. Two necks allows the guitarist to switch quickly and easily between guitar sounds without taking the time to change guitars.

There are many ways to customize a multiple-necked guitar, such as the number of strings on a neck, frets or no frets, the tuning used on each neck, etc. One of the earliest designs still in regular use is the acoustic contraguitar, invented around 1850 in Vienna. This guitar, also known as the Schrammel guitar, has a fretted six-string neck and a second, fretless neck with up to nine bass strings.

One of the more common combinations is where one neck of a double-necked guitar is set up as for a 6 string guitar and the other neck is configured as a 4 string bass guitar. Guitarist Pat Smear of the Foo Fighters utilizes a double-necked guitar during live performances (bass guitar top neck, six-string electric guitar bottom neck) in order to perform Krist Novoselic's bass part in the song "I Should Have Known," from the album Wasting Light, in addition to his own duties. Rickenbacker International Corporation and Gibson Guitar Corporation in the USA have both manufactured production models of these configurations in the past.

A less common configuration has a 12 string guitar neck combined with a 4 string bass guitar neck: Geddy Lee of Rush is well known for using the 4/12-string Rickenbacker 4080/12 production model live in the 1970s.

In the 1970s and 1980s Mike Rutherford of Genesis was known for playing a custom-made Shergold Modulator twin-neck guitar-bass unit in live shows, as he frequently changed between lead guitar, 12-string guitar and bass guitar, depending on the arrangement of the song. The unique design concept of Rutherford's Shergold guitar set is that it consists of several interchangeable modular elements, each of which could be separated and recombined, and which attached to the other units through a system of dowels and thumbscrews, and an electrical connector. The complete original set consisted of a "top section" 6-string guitar, two "top-section" 12-string guitars (each in a different tuning), and a "bottom-section" 4-string bass. Each section could be separated and re-attached to create a variety of twin-neck combinations, with either the 6-string or one of the two 12-strings on the top, and the 4-string bass on the bottom, and there was a matching lower-body section which could be attached to the 6-string and 12-string main units, which created a single complete guitar when these were not attached to the bass.

Electric bass guitars with two or more necks have existed at least since the 1970s. Some basses have three or more necks, but usually upon custom order only. A double-necked bass guitar can be used for multiple tuning (e.g., B-E-A-D on one neck and E-A-D-G on the other, etc.); combining fretted and fretless necks; combining necks with different numbers of strings, etc.

One of the more well-known multiple-necked bass guitars is that used by Chris Squire (of Yes) for the song "Awaken." This is a replica of a guitar built by Wal for Roger Newell of the English Rock Ensemble. Squire's original triple-necked bass guitar was configured with a four-string fretted neck, a four-string fretless neck, and a six-string tuned in octaves (Squire was known to have tuned it to aA-dD-gG). This bass is currently on display at the Hard Rock Cafe. Steve Digiorgio used a multiple-necked bass guitar with a fretless neck and another fretted neck. A number of makers have also produced double neck basses with an 8-string bass neck (double courses, tuned in octaves like a 12-string guitar) on top and a 4-string bass neck on the bottom. Double neck basses with various other combinations exist, for example: four string and five string bass; four string and six string bass; etc.

Multiple neck "guitars" have also been made which include other stringed instruments among the alternate necks. Country guitarist Joe Maphis famously played a double-neck Mosrite instrument that had a regular 6-string neck on the bottom and an "octave guitar" for the top neck. This was a 6-string neck tuned an octave higher than the standard guitar, that both extended the range of the instrument, and allowed Maphis to play mandolin-like sounds. Between 1958-1968, Gibson made an instrument of this type which it called the "Double Mandolin". Hybrids with a 6-string guitar neck and a true 8-string mandolin neck were also made (e.g., the 1971 Dawson Electric guitar/mandolin). And Led Zeppelin's John Paul Jones has a triple-neck electroacoustic instrument, custom made for him by luthier Andy Manson, which features (from top to bottom) 8-string mandolin, 12-string guitar, and 6-string guitar necks.

Pro Electric has produced a quadruple-necked instrument some have called the "ultimate bluegrass axe," not entirely without sarcasm. This solid-body electric instrument combines 6-string guitar, 4-string bass, 8-string mandolin, and 5-string banjo necks into one (heavy) package.

Canadian country music star Steve Puto owns a five-neck instrument that includes guitar, bass, banjo, mandolin, and fiddle necks—with a harmonica mounted on the fiddle body, for good measure. Puto says he found the instrument (which bears no maker's name) in 1973 in a friend's music shop, and he played it regularly on his TV show (The Lonesome Steve Show) in the 1970s.

In 2011, the National Guitar Museum unveiled the "Rock Ock", which it calls the world's largest fully playable multi-necked stringed instrument. The 8-necked guitar weighs 40 pounds, has 154 frets, 51 strings, and 8 necks. The eight instruments are a mandolin, ukulele, 6-string, fretless bass, standard bass, 12-string, baritone guitar, and a 7-string. The guitar was designed by noted artist Gerard Huerta and built by Dan Neafsey of DGN Custom Guitars. The guitar hardware was supplied by Mojo Musical Supply while the instrument itself was commissioned by the National Guitar Museum.

Some luthiers not only built guitars with two necks in common configurations, but worked to expand the possibilities with multiple necks, extra bridges, odd configurations, and the like. Hans Reichel crafted a series of third bridge guitars with two necks on both sides of the body. Linda Manzer crafted the Pikasso guitar (a three neck guitar with 42 strings) for Pat Metheny. Solmania is an Osaka-based noise music band known for making their own experimental electric guitars out of spare parts. The guitars usually take an extremely bizarre form, utilizing unconventional body shapes, extra necks, strings and pickups in unusual places, and various extraneous gadgets such as microphones. Most of their instruments are double neck guitars or harp guitars.

Many of those who have played double neck guitars report that the instruments are heavy and awkward, but this can be managed with practice. Triple neck instruments are even weightier and more unwieldy. This raises the question as to whether some of the larger varieties of multi-neck guitar are even playable as guitars, much less practical in performance situations. The bottom neck of Rick Nielsen's famous five-neck Hamer guitar is barely reachable by a person of average stature holding the instrument in a normal standing playing position, and it's hard to see how that neck could be played with any facility with both arms extended to their limit just to reach it. Although playable hybrids with up to eight necks have been produced (see the "Rock Ock", above), five necks would seem to be the practical limit for multi-neck guitars.

Luthiers seem, however, to be undeterred by either practicality, or by the limits of human anatomy, and have produced instruments with even more necks. In 2008 Macari's Music of London commissioned a six neck guitar ("the beast"), similar in design to Nielsen's five neck. Yamantaka Eye, of the Japanese noise/rock band Boredoms has toured with a seven neck guitar (the "Sevena"). This instrument has four necks on one side and three on the other, and is mounted on a stand and played with drumsticks as a percussion instrument. As of 2012, the most necks placed on a single guitar is 12, apparently first achieved in 2002 by Japanese artist Yoshihiko Satoh.

Despite all the efforts listed above prior art patents describe structures that are either not truly convenient or else involve complicated, expensive, and overly difficult assembly and/or disassembly parts and procedures. Other devices have been advertised on various media but never patented or described into a printed publication.

SUMMARY OF THE INVENTION

The inventive device described in the instant application is a novel musical instrument. The Fuccion is an innovative new concept designed to be primarily used in music performances as both a bass guitar and an electric guitar. This will provide the user with the ability to play music within a band or performance both as bass and as guitar. The Fuccion goes beyond just combining two different instruments because the final result is in fact a novel concept. The Fuccion is a 10 String Instrument having a 6 string guitar formation above a 4 string bass formation designed to play both parts simultaneously. This is due to the innovative body design which situates the necks in this unique staggered position allowing the right hand to both strum the guitar with the thumb and hammer out the bass notes together with four fingers. Both necks are reachable in a single hand span.

It is then the principal object of the present invention is to provide a novel and versatile musical device to be used in performances.

It is a secondary objective of the present invention to allow the user to become adept at using both a bass guitar and electric guitar simultaneously.

It is an additional objective of the present invention to provide a device that does not rust or deteriorate over time. It is a final objective of the present invention to provide for a device that is relatively inexpensive to build, but that can eventually be sold at a premium.

These and other objective achieved by the device of the present invention will be apparent by the drawings, by their detailed description, and by the specification here from appended.

DESCRIPTION OF THE PREFERRED EMBODIMENT

Figure 1:
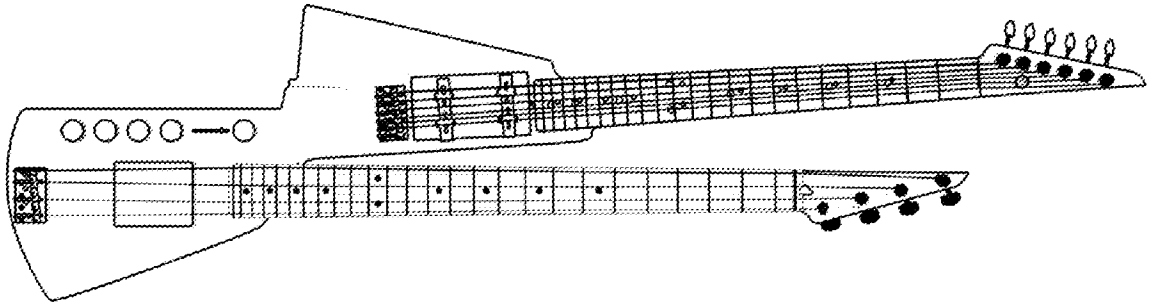
FIG. 1 is a front elevation view of one of the preferred embodiments of "Fuccion" in accordance with the teachings of the present invention.
Figure 2:
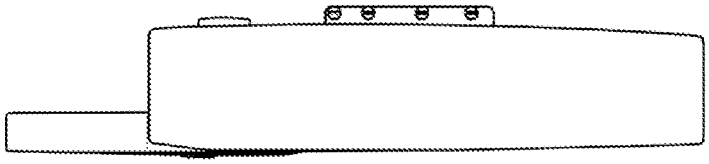
FIG. 2 is a bottom elevation view of "Fuccion" of FIG. 1.
Figure 3:
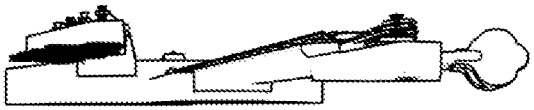
FIG. 3 is a top elevation view of "Fuccion" of FIG. 1.
Figure 4:
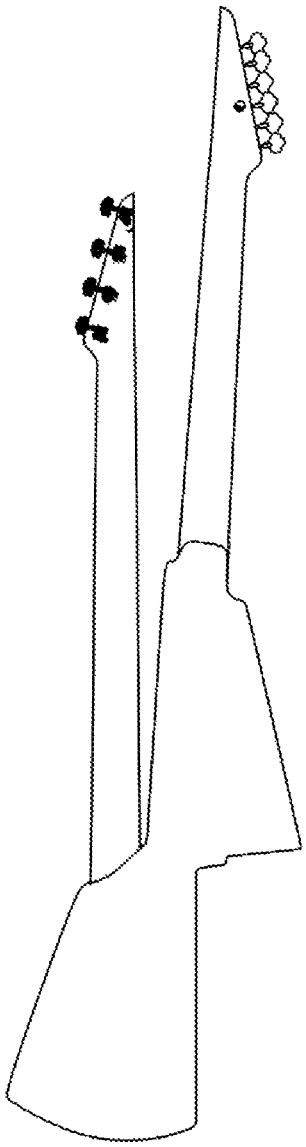
FIG. 4 is a rear elevation view of "Fuccion" of FIG. 1.
Figure 5:
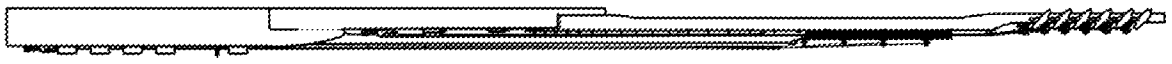
FIG. 5 is a left side elevation view of the "Fuccion" of FIG. 1.
Figure 6:
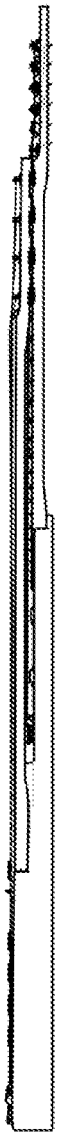
FIG. 6 is a right side elevation view of the "Fuccion" of FIG. 1.
Figure 7:
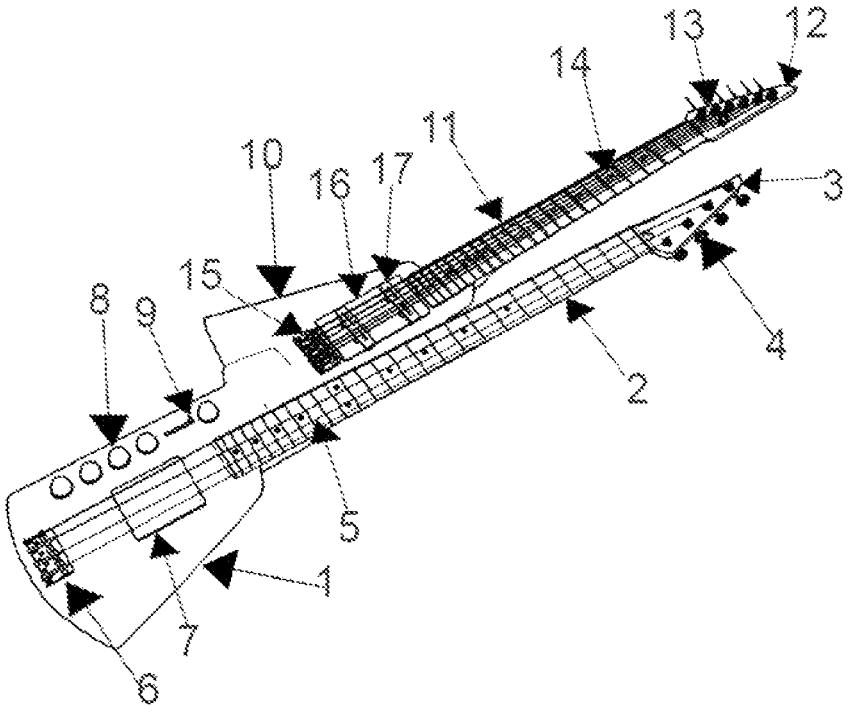
FIG. 7 is a side perspective detail view of one of a separate preferred embodiments of "Fuccion" in accordance with the teachings of the present invention.
Figure 8:
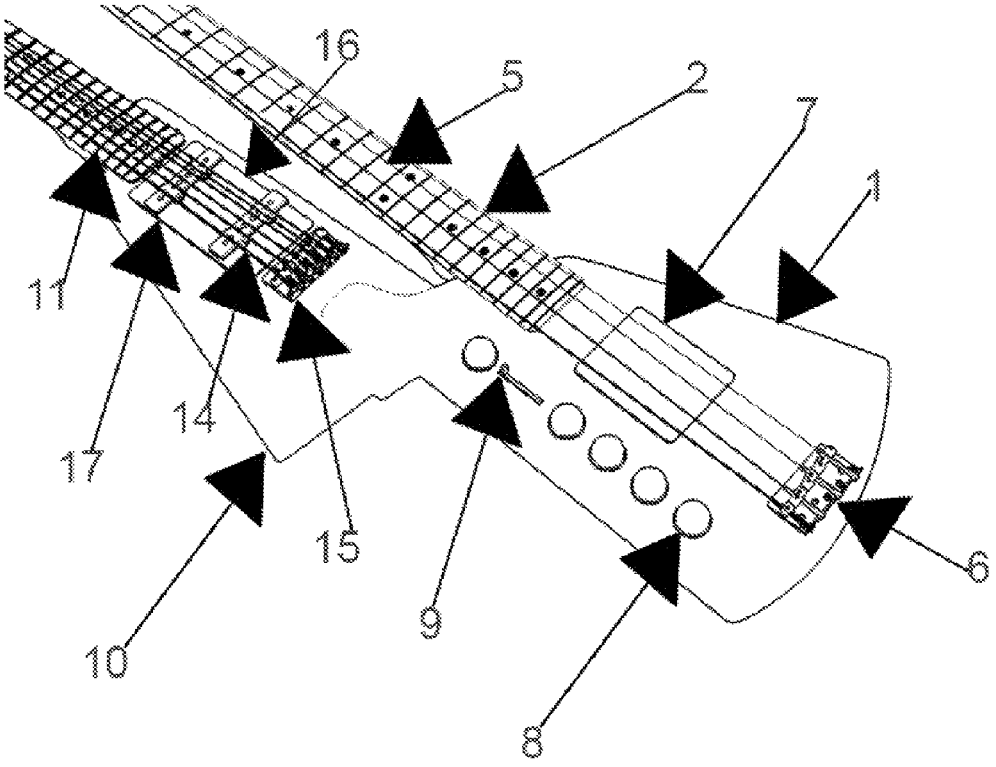
FIG. 8 is a top detail perspective view of "Fuccion" of FIG. 7.
Figure 9:
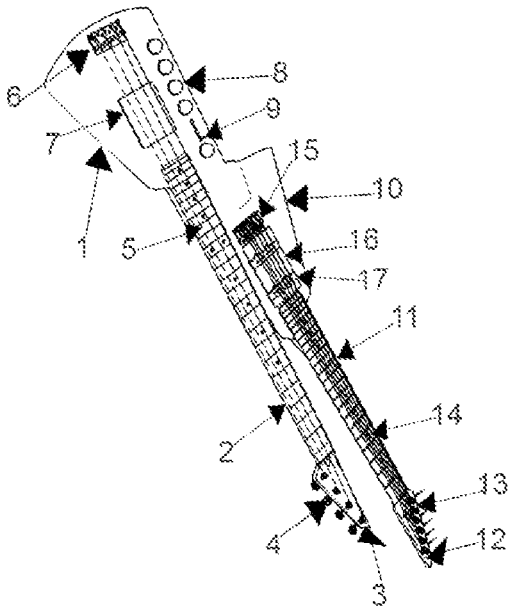
FIG. 9 is a top detail perspective view of "Fuccion" of FIG. 7.

The inventive device described in the instant application is a novel musical instrument. The Fuccion is designed to be primarily used in music performances as both a bass guitar and an electric guitar. This will provide the user with the ability to play music within a band or performance both as bass and as guitar. The Fuccion goes beyond just combining two different instruments because the final result it is in fact a novel concept. The Fuccion is a 10 String Instrument having a 6 string guitar formation above a 4 string base formation designed to play both parts simultaneously. This is due to the innovative body design which situates the necks in this unique staggered position allowing the right hand to both strum the guitar with the thumb and hammer out the bass notes with four fingers. Both necks are reachable in a single hand span.

The Fuccion is designed to be an efficient way for the user to play both the electric guitar and bass guitar simultaneously. This device can be used in the home or in a music performance. In one preferred embodiment of "Fuccion" of the present application will be applied various other model forms and sizes.

The most important element of the Fuccion of the present application is the body of the instrument that allows for two separate necks to attach to it in this unique staggered position. The premise is to give the user ability to play together both a normal guitar and a bass guitar simultaneously.

Users can use the compound music device to play both the positions of the guitarist and bassist. The "Fuccion" provides an easy way to become adept in two musical instruments.

A guitar is a popular musical instrument that makes sound by the playing of its (typically) six strings with the sound being projected either acoustically or through electrical amplification (for an acoustic guitar or an electric guitar, respectively). It is typically played by strumming or plucking the strings with the right hand while fretting the strings with the left hand. The guitar is a type of chordophone, traditionally constructed from wood and strung with either nylon or steel strings and distinguished from other chordophones by its construction and tuning. The modern guitar was preceded by the lute, the vihuela, the four-course Renaissance guitar, and the five-course baroque guitar, all of which contributed to the development of the modern six-string instrument.

The bass guitar (also called electric bass, or simply bass) is a stringed instrument played primarily with the fingers or thumb, by plucking, slapping, popping, tapping, thumping, or picking with a plectrum, often known as a pick. The bass guitar is similar in appearance and construction to an electric guitar, but with a longer neck and scale length, and four to six strings or courses. The four-string bass—by far the most common—is usually tuned the same as the double bass, which corresponds to pitches one octave lower than the four lowest pitched strings of a guitar (E, A, D, and G). The bass guitar is a transposing instrument, as it is notated in bass clef an octave higher than it sounds (as is the double bass) to avoid excessive ledger lines. Like the electric guitar, the bass guitar is plugged into an amplifier and speaker for live performances.

A multi-neck guitar is a guitar that has multiple fingerboard necks. They exist in both electric and acoustic versions. Although multi-neck guitars are quite common today, they are not a modern invention. Examples of multi-neck guitars and lutes go back at least to the Renaissance. Today, the most common type of multi-neck guitar is the double neck guitar, of which the most common version is an electric guitar with twelve strings on the upper neck, while the lower neck has the normal six. Combination six-string and bass guitar are also used, as well as a fretless guitar with a regular fretted guitar, or any other combination of guitar neck and pickup styles. There are also acoustic versions. Two necks allows the guitarist to switch quickly and easily between guitar sounds without taking the time to change guitars.

In one of its preferred embodiments the inventive device of the present application embodies a musical compound device comprises: The main body (1), with the connecting neck (2) with the corresponding bass head (3) with the adjoining metal bass tuning knobs (4) that in turn tunes the bass guitar strings (5) that are connected to the metal bass string hook (6) that is under the bass guitar resonator (7). With the sound being adjusted by the audio knobs (8) and the level bar (9). The guitar body (10) is connected to the main body (1), with the guitar body connected to the guitar neck (11) which leads into the guitar head (12) and the tuning metal guitar knobs (13) that tune the guitar strings (14) that is held down by the metal guitar string hook (15) that is located under the guitar resonator (16) that has the guitar stabilizer (17).

The bass guitar is a stringed instrument played primarily with the fingers or thumb, by plucking, slapping, popping, tapping, thumping, or picking with a plectrum, often known as a pick. The bass guitar is similar in appearance and construction to an electric guitar, but with a longer neck and scale length, and four to six strings or courses. The four-string bass—by far the most common—is usually tuned the same as the double bass, which corresponds to pitches one octave lower than the four lowest pitched strings of a guitar (E, A, D, and G). The bass guitar is a transposing instrument, as it is notated in bass clef an octave higher than it sounds (as is the double bass) to avoid excessive ledger lines. Like the electric guitar, the bass guitar is plugged into an amplifier and speaker for live performances.

Since the 1960s, the bass guitar has largely replaced the double bass in popular music as the bass instrument in the rhythm section. While types of bass lines vary widely from one style of music to another, the bassist usually fulfills a similar role: anchoring the harmonic framework and establishing the beat. Many styles of music utilize the bass guitar, including rock, metal, pop, punk rock, country, reggae, gospel, blues, and jazz. It is often a soloing instrument in jazz, jazz fusion, Latin, funk, progressive rock and other rock and metal styles.

Bass bodies are typically made of wood, although other materials such as graphite have also been used. While a wide variety of woods are suitable for use in the body, neck, and fret board of the bass guitar, the most common type of wood used for the body is alder, for the neck is maple, and for the fret board is rosewood. Other commonly used woods include mahogany, maple, ash, walnut, and poplar for bodies, mahogany for necks, and maple and ebony for fret boards.

Other design options include finishes, such as lacquer, wax and oil; flat and carved designs; Luthier-produced custom-designed instruments; headless basses, which have tuning machines in the bridge of the instrument (e.g., Steinberger and Hohner designs) and several artificial materials such as luthite. The use of artificial materials (e.g., BassLab) allows for unique production techniques such as die-casting, to produce complex body shapes. While most basses have solid bodies, they can also include hollow chambers to increase the resonance or reduce the weight of the instrument. Some basses are built with entirely hollow bodies, which change the tone and resonance of the instrument. Acoustic bass guitars are typically equipped with piezoelectric or magnetic pickups and amplified.

Instruments handmade by highly skilled luthiers are becoming increasingly available. Exotic materials include woods such as bubinga, wenge, ovangkol, ebony and goncalo alves. Graphite composite is used to make lightweight necks. Exotic woods are used on more expensive instruments: for example, Alembic uses cocobolo as a body or top layer material because of its attractive grain. Warwick bass guitars are also well known for exotic hardwoods: most of the necks are made of ovangkol, and the fingerboards wenge or ebony. Solid bubinga bodies are also used for tonal and aesthetic qualities.

A common feature of more expensive basses is "neck-through" construction. Instead of milling the body from a single piece of wood (or "bookmatched" halves) and then attaching the neck into a pocket (so-called "bolt-on" design), neck-through bases are constructed first by assembling the neck, which may comprise one, three, five or more layers of wood in vertical stripes, which are longer than the length of the fretboard. To this elongated neck, the body is attached as two wings, which may also be made up of several layers. The entire bass is then milled and shaped. Many players believe neck-through construction provides better sustain and a mellower tone than bolt-on neck construction. While neck-through construction is most common in handmade "boutique" basses, some models of mass-produced basses such as Ibanez's BTB series also have neck-through construction. Bolt-on neck construction doesn't necessarily imply a cheaply made instrument; virtually all traditional Fender designs still use bolt-on necks for instruments costing thousands of dollars, and many boutique luthiers build bolt-on basses as well as neck-through.

The number of frets installed on a bass guitar neck may vary. The original Fender basses had 20 frets, and most bass guitars have between 20 and 24 frets or fret positions. Instruments with between 24 and 36 frets (2 and 3 octaves) also exist. The long scale necks on Leo Fender's basses—with a scale length (distance between nut and bridge) of 34 inches—set the standard for electric basses, although 30 inch "short scale" instruments, such as the Höfner 500/1 "violin bass" played by Paul McCartney, and the Fender Mustang Bass are also common. While 35", 35.5" and 36" scale lengths were once only available in "boutique" instruments, in the 2000s (decade), many manufacturers began offering these "extra-long" scale lengths. This extra-long scale provides a higher string tension, which may yield a more defined tone on the low "B" string of five- and six-stringed instruments (or detuned four-string basses).

Electric guitars can have solid, semi-hollow, or hollow bodies; solid bodies produce little sound without amplification. Electromagnetic pickups convert the vibration of the steel strings into signals, which are fed to an amplifier through a cable or radio transmitter. The sound is frequently modified by other electronic devices or the natural distortion of valves (vacuum tubes) in the amplifier. There are two main types of magnetic pickups, single- and double-coil (or hum bucker), each of which can be passive or active. The electric guitar is used extensively in jazz, blues, R & B, and rock and roll. The first successful magnetic pickup for a guitar was invented by George Beauchamp, and incorporated into the 1931 Ro-Pat-In (later Rickenbacker) "Frying Pan" lap steel; other manufacturers, notably Gibson, soon began to install pickups in arch top models.

After World War II the completely solid-body electric was popularized by Gibson in collaboration with Les Paul, and independently by Leo Fender of Fender Music. The lower fretboard action (the height of the strings from the fingerboard), lighter (thinner) strings, and its electrical amplification lend the electric guitar to techniques less frequently used on acoustic guitars. These include tapping, extensive use of legato through pull-offs and hammer-ons (also known as slurs), pinch harmonics, volume swells, and use of a tremolo arm or effects pedals.

The electric bass guitar is similar in tuning to the traditional double bass viol. Hybrids of acoustic and electric guitars are also common. There are also more exotic varieties, such as guitars with two, three, or rarely four necks, all manner of alternate string arrangements, fretless fingerboards (used almost exclusively on bass guitars, meant to emulate the sound of a stand-up bass), 5.1 surround guitar, and such.

Some electric guitar and electric bass guitar models feature piezoelectric pickups, which function as transducers to provide a sound closer to that of an acoustic guitar with the flip of a switch or knob, rather than switching guitars. Those that combine piezoelectric pickups and magnetic pickups are sometimes known as hybrid guitars.

In a separate preferred embodiment of the FUCCION of the present application, the invention consists in a compound musical device comprising: a main body connected to a neck that leads into the bass head that has attached bass tuning knobs that tunes the attached bass strings that are held by the bass string hooks that are located under the bass guitar resonator, with the audio knobs that adjust the sound with the audio bar; with the above located guitar body that leads into the guitar neck that ends on the guitar head that has the connected tuning guitar knobs which tune the connecting guitar strings which are grounded by the guitar string hooks located under the guitar resonator that has a connecting guitar stabilizer.

The body of the compound musical device of the present application may be made of wood to allow to not conduct electricity, the same main body is allows for the users to use the bass instrument. The neck may be made of wood. The user can play musical notes either as a guitar or a bass. The bass head is made from wood and may be located on the end of the neck. The bass tuning knobs are made of metal to properly tune the bass guitar and could be adjusted by the user to play alternating sounds. The bass guitar strings can be either nylon or steel strings and may be tuned by the bass tuning knobs by the user. The bass string hook are made from metal to properly ground the bass guitar strings.

The bass guitar resonator is made of wood and may be able to easily receive the sounds from the bass guitar strings. The audio knobs are made of metal and have a chrome finish, they control the volume, tone and pitch of the device. The level bar controls the pitch of the sound of the device and is made of metal. The guitar body is made of wood and connected to the main body. The guitar neck allows the user to play music using the device's guitar capabilities and is made of wood. The guitar head is made of wood and allows for the tuning of the guitar. The tuning guitar knobs are made of metal and tune the device's guitar capability to perform music. The guitar strings are made either from nylon of metal and are necessary to perform music. The guitar string hook is made of metal and securely keep the guitar strings taut to play music. The guitar resonator receives the sounds from the guitar strings efficiently.

Figure 10:
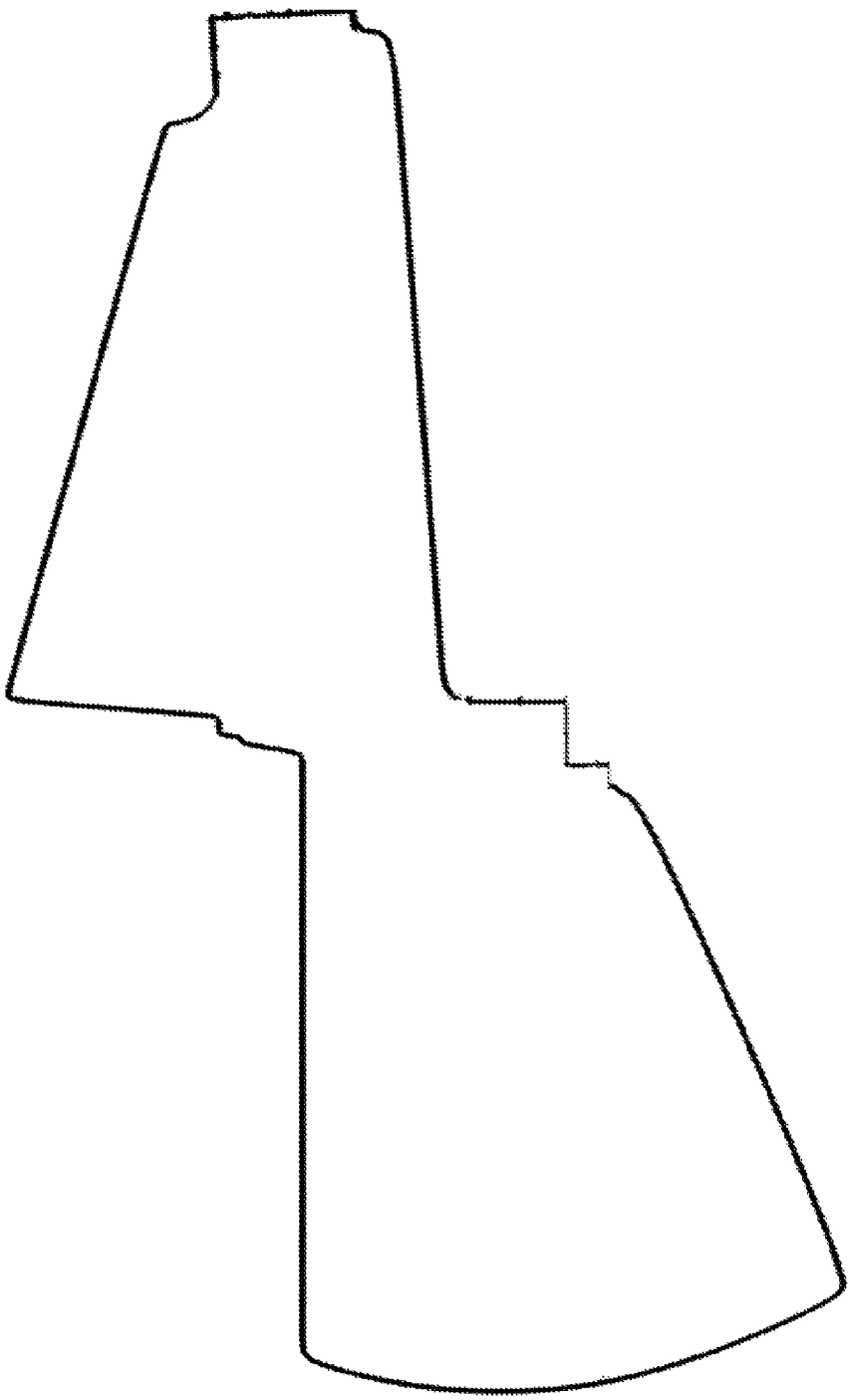
FIG. 10 is a front detail elevation view of the body of the "Fuccion" of the present application.
Figure 11:
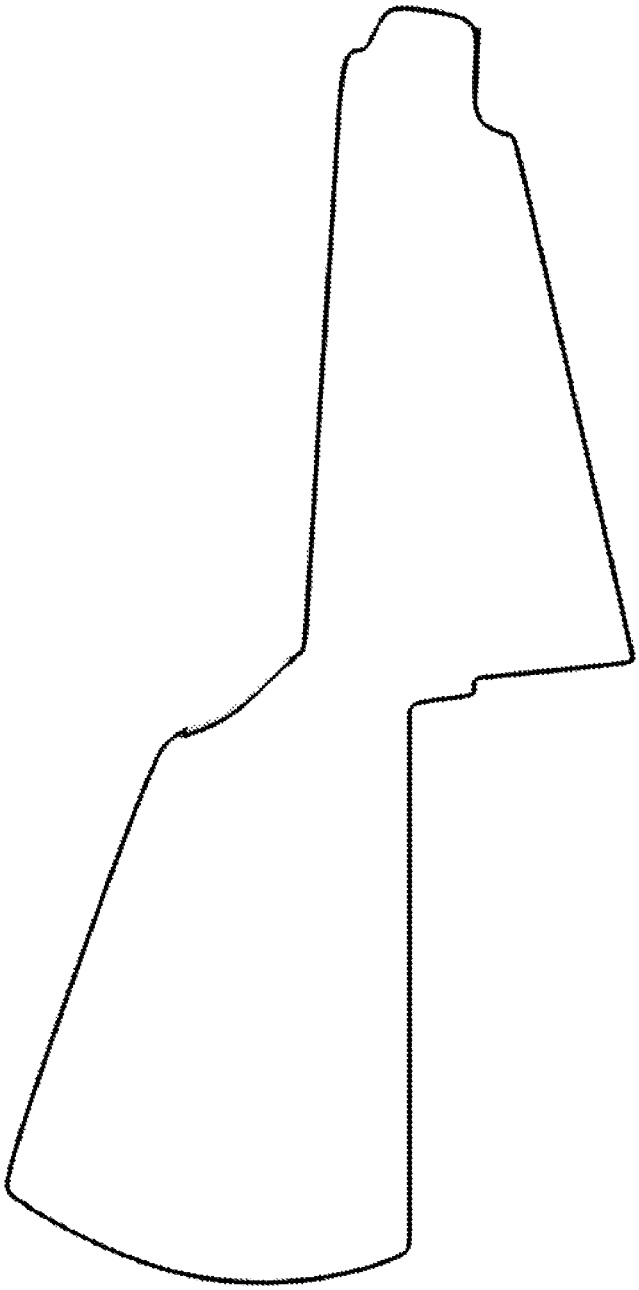
FIG. 11 is a back detail elevation view of the body of the "Fuccion" of the present application.
Figure 12:
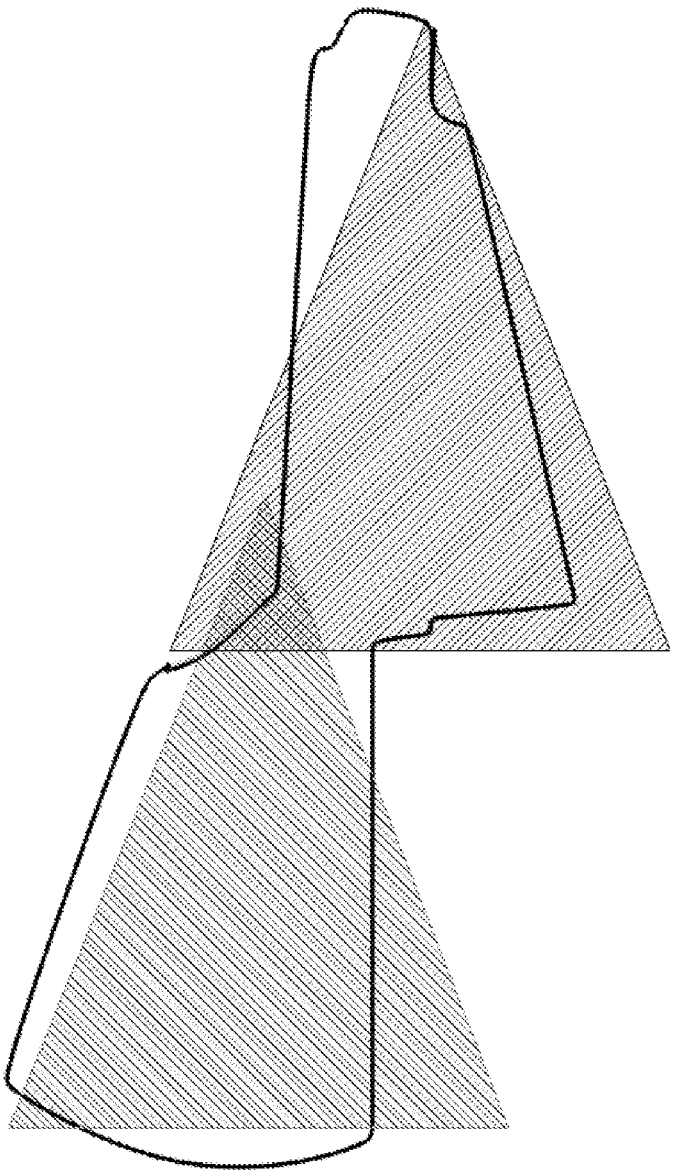
FIG. 12 is a diagram showing how important it is for the body of the FUCCION of the present application to basically be constituted by two isoceles triangles overlapping on one of their corners: the overlapping region is in between the upper tip of the lower triangle and the left side bottom corner of the upper triangle.

The guitar stabilizer accurately receives the sound from the guitar strings. It is to be understood that the body is the most important part of the Fuccion. The Fuccion body, as shown in FIGS. 10 and 11 is formed by two triangles shifted in a way that one overlaps the other one to a minimum. In a way only one of the corner of the two triangles overlaps keeping together the two components.

The neck are secured to the outmost tips of the triangles via fastening means that can be bolts, nuts, nails, screw, and pins. The necks are interchangeable: therefore the player can have the six string guitar on the top triangle or on the bottom one. The top triangle is the one that is on the top of the instrument. When it's played is the one closer to the head of the player.

The bottom triangle is the one that is physically in the bottom, when is played is the one that is closed to the ground.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A compound musical device comprising:

a. a main body constituted by two isoceles triangles overlapping on one corner: where the overlapping region is in between the upper tip of the lower triangle and the left side bottom corner of the upper triangle; where said main body is connected to a b. bass neck leading into a c. bass head having attached d. bass tuning knobs tuning a plurality of e. bass strings held by f. corresponding bass string hooks located under a g. bass guitar resonator;

h. audio knobs i. an audio bar;

k. a guitar neck ending on a l. guitar head: said guitar head having m. tuning guitar knobs connecting n. a plurality of guitar strings grounded by a corresponding plurality of o. guitar string hooks located under said p. guitar resonator connecting to a q. guitar stabilizer.

2. The compound musical device of claim 1 where said main body constituted by two isoceles triangles overlapping on one corner: where the overlapping region is in between the upper tip of the lower triangle and the left side bottom corner of the upper triangle is made of wood.

3. The compound musical device of claim 1 where said bass neck is made of wood.

4. The compound musical device of claim 1 where said bass head is made of wood.

5. The compound musical device of claim 1 where said bass tuning knobs are made of metal.

6. The compound musical device of claim 1 where said bass strings are steel strings.

7. The compound musical device of claim 1 where said bass guitar resonator is made of wood.

8. The compound musical device of claim 1 where said audio knobs are made of metal having a chrome finish.

9. The compound musical device of claim 1 where said guitar neck is made of wood.

10. The compound musical device of claim 1 where said guitar head is made of wood.

11. The compound musical device of claim 1 where said tuning guitar knobs are made of metal.

12. The compound musical device of claim 1 where said guitar strings are made of metal.

* * * * *